US008646444B2

(12) United States Patent
Williams et al.

(10) Patent No.: US 8,646,444 B2
(45) Date of Patent: Feb. 11, 2014

(54) GLIDE RACK

(75) Inventors: Daniel Wayne Williams, White House, TN (US); Jason Paul Norberg, Nashville, TN (US); Bryan Thomas Phillips, Hendersonville, TN (US); Julie Anne Robinson, Portland, TN (US); Timothy Paul Doyal, Goodlettsville, TN (US); Jeffrey A. Ambrose, Evansville, IN (US); Jason Robert Yochum, Princeton, IN (US)

(73) Assignee: Electrolux Home Products, Inc., Charlotte, NC (US)

( * ) Notice: Subject to any disclaimer, the term of this patent is extended or adjusted under 35 U.S.C. 154(b) by 1356 days.

(21) Appl. No.: 11/691,633

(22) Filed: Mar. 27, 2007

(65) Prior Publication Data

US 2008/0237166 A1 Oct. 2, 2008

(51) Int. Cl.
*F24C 15/16* (2006.01)

(52) U.S. Cl.
USPC ..... 126/339; 126/332; 126/333; 126/334; 312/280; 312/351; 211/169.1; 99/449

(58) Field of Classification Search
USPC ..... 126/339, 332, 333, 334; 312/380, 351; 211/169.1, 168, 169, 170; 99/449
See application file for complete search history.

(56) References Cited

U.S. PATENT DOCUMENTS

| | | | | |
|---|---|---|---|---|
| 434,970 | A | 8/1890 | Allyn | |
| 771,877 | A | 10/1904 | Kueblar | |
| 878,434 | A | 2/1908 | Van Houten | |
| 1,951,390 | A | 3/1934 | Barker | |
| 1,953,688 | A | 4/1934 | Otte | |
| 1,973,416 | A * | 9/1934 | Otte | 108/143 |
| 2,033,792 | A * | 3/1936 | Sywert et al. | 211/153 |
| 2,033,859 | A | 3/1936 | Otte | |
| 2,033,860 | A | 3/1936 | Otte | |
| 2,033,861 | A | 3/1936 | Otte | |
| 2,078,681 | A | 4/1937 | Otte | |
| 2,098,198 | A | 11/1937 | Sindelar | |
| 2,671,004 | A | 3/1954 | Chadwick et al. | |
| 6,148,813 | A * | 11/2000 | Barnes et al. | 126/339 |
| 6,789,861 | B1 * | 9/2004 | Dobberstein | 312/330.1 |
| 6,938,617 | B2 | 9/2005 | Le et al. | |

* cited by examiner

*Primary Examiner* — Avinash Savani
(74) *Attorney, Agent, or Firm* — Pearne & Gordon LLP

(57) ABSTRACT

A rack for an appliance includes a main section having a support frame, and an arm coupled to the support frame and movable relative to the support frame between a first position and a second position. In one example, the arm is movable towards the first position and is configured for engagement with a stop portion of an appliance cavity for inhibiting removal of the main section therefrom. In another example, the appliance cavity includes at least one stop portion, and the arm is movable towards engagement with the stop portion for inhibiting removal of the main section from the appliance cavity.

19 Claims, 13 Drawing Sheets

GLIDE RACK

RELATED APPLICATIONS

Not Applicable.

BACKGROUND OF THE INVENTION

1) Field of the Invention

The present invention relates to racks for appliances, and more particularly, to a glide rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a rack for an appliance includes a main section having a support frame and an arm coupled to the support frame. The arm is pivotable relative to the support frame between a first position and a second position. The arm is configured for pivoting movement towards the first position for engagement with a stop portion of an appliance cavity for inhibiting removal of the main section therefrom.

In accordance with another aspect of the present invention, an appliance includes an appliance cavity having a pair of sidewalls. Each sidewall includes a guide rail, and the cavity includes at least one stop portion. The appliance also includes a rack for supporting items within the appliance cavity. The rack includes a main section having a support frame adapted to be supported by the guide rails, and an arm coupled to the support frame. The arm is movable relative to the support frame towards engagement with the stop portion for inhibiting removal of the main section from the appliance cavity.

In accordance with another aspect of the present invention, an appliance includes an appliance cavity having a pair of sidewalls. Each sidewall includes a guide rail, and the cavity includes at least one stop portion. The appliance also includes a rack for supporting items within the appliance cavity. The rack includes a main section having a support frame adapted to be supported by the guide rails, and an auxiliary section having an auxiliary platform area. The auxiliary section is adapted to be slidably coupled to the main section for movement along a first axis between a retracted position and an extended position. An arm is coupled to the support frame and is pivotable relative to the support frame about a second axis generally orthogonal to the first axis. The arm is movable away from the main section and towards engagement with the stop portion for inhibiting removal of the main section from the appliance cavity.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
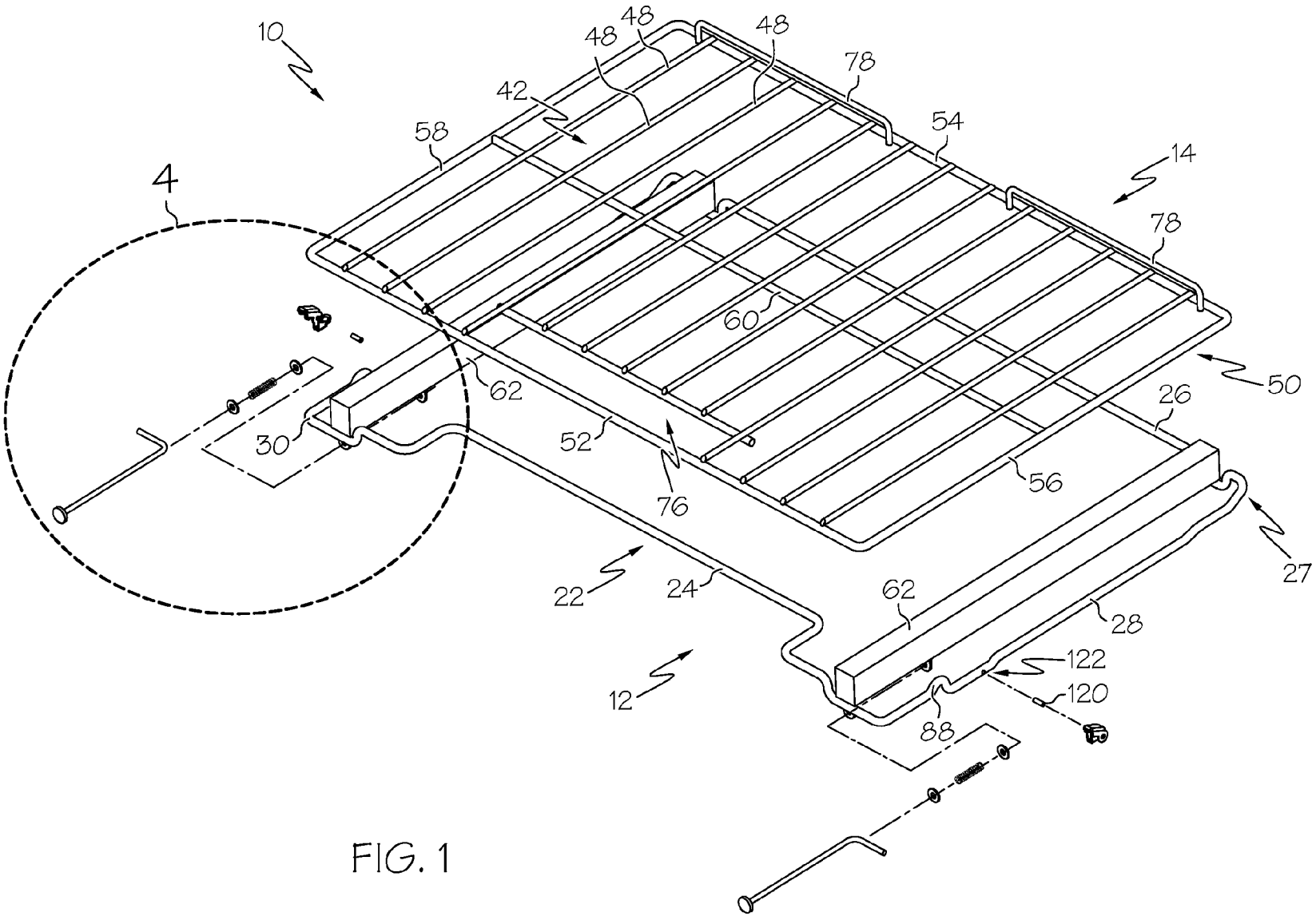
FIG. 1 illustrates an exploded, perspective view of an example of glide rack having a main section and an auxiliary section in accordance with an aspect of the present invention.

The present invention relates to a slide-out half rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Referring initially to FIG. 1, an example of a rack 10 for an appliance, such as an oven, refrigerator, or freezer is illustrated in accordance with an aspect of the present invention. For the sake of brevity, the rack 10 will be described with reference to an example oven rack, though it is to be appreciated that such example description is not intended to provide a limitation upon the present invention. The rack 10 includes a main section 12, and can also include an auxiliary section 14. As shown, the auxiliary section 14 can be relatively the same size as the main section 12, though it can also be relatively larger or smaller than the main section 12 (e.g., occupying a partial area of the rack 10). In addition or alternatively, the rack 10 can include more than one auxiliary section 14 coupled directly or indirectly to the main section 12.

Both the main section 12 and the auxiliary section 14 can be constructed from metal wire, such as iron coated with nickel or steel coated with porcelain. However, it is to be appreciated that either or both of the main section 12 and the auxiliary section 14 can be constructed from various other suitable materials (e.g., aluminum, sheet metal, or the like). Moreover, it is to be appreciated that the main section 12 can be constructed from a first material and the auxiliary section 14 can be constructed from a second different material. The auxiliary section 14 can be coupled to the main rack in various manners. For example, as shown, the auxiliary section 14 can be is adapted to be slidably coupled to the main section 12, as will be discussed more fully herein.

The main section 12 can include a support frame 22 having a front bar 24, rear bar 26, and apposed side bars 28, 30 that can be attached together to form the support frame 22 in various manners, such as by welding, adhesives, or fasteners, and/or can even be formed from a single piece of wire. As shown, the support frame 22 can have a generally rectangular geometry, through it is to be appreciated that the support frame 22 can also have various other geometries. Additionally, the main section 12 can include various geometries to facilitate support of the main section 12 within an appliance. For example, as shown, the rear bar 26 of the support frame 22 can be located at a relatively higher position with respect to the front bar 24. Thus, a portion of the support members 20 attached to the rear bar 26 can act as a stop 27 to limit the extent to which an item can be inserted into an oven cavity.

Figure 2A:
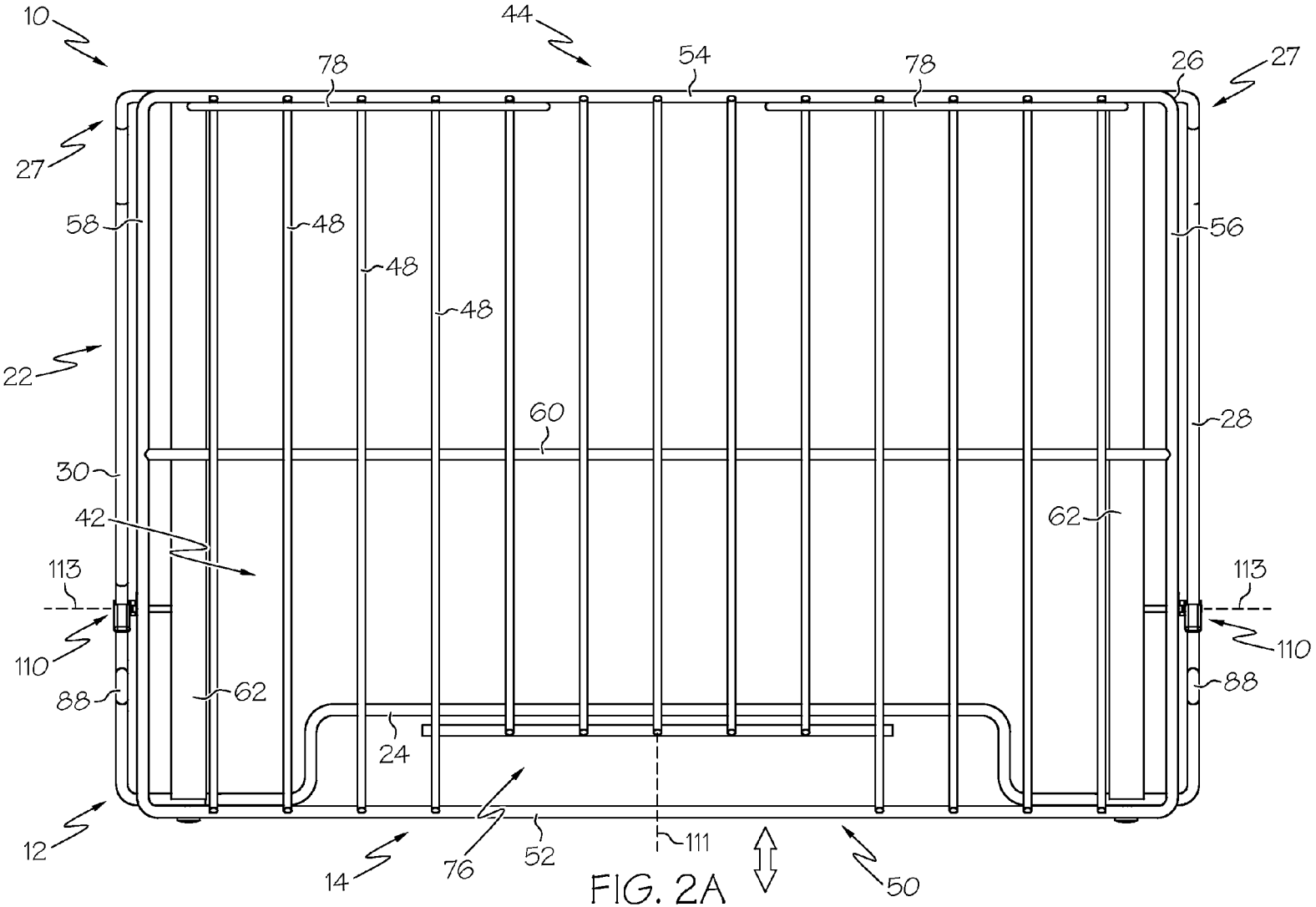
FIG. 2A is similar to FIG. 1, but illustrates a top view in which the main section is in an example retracted position.
Figure 2B:
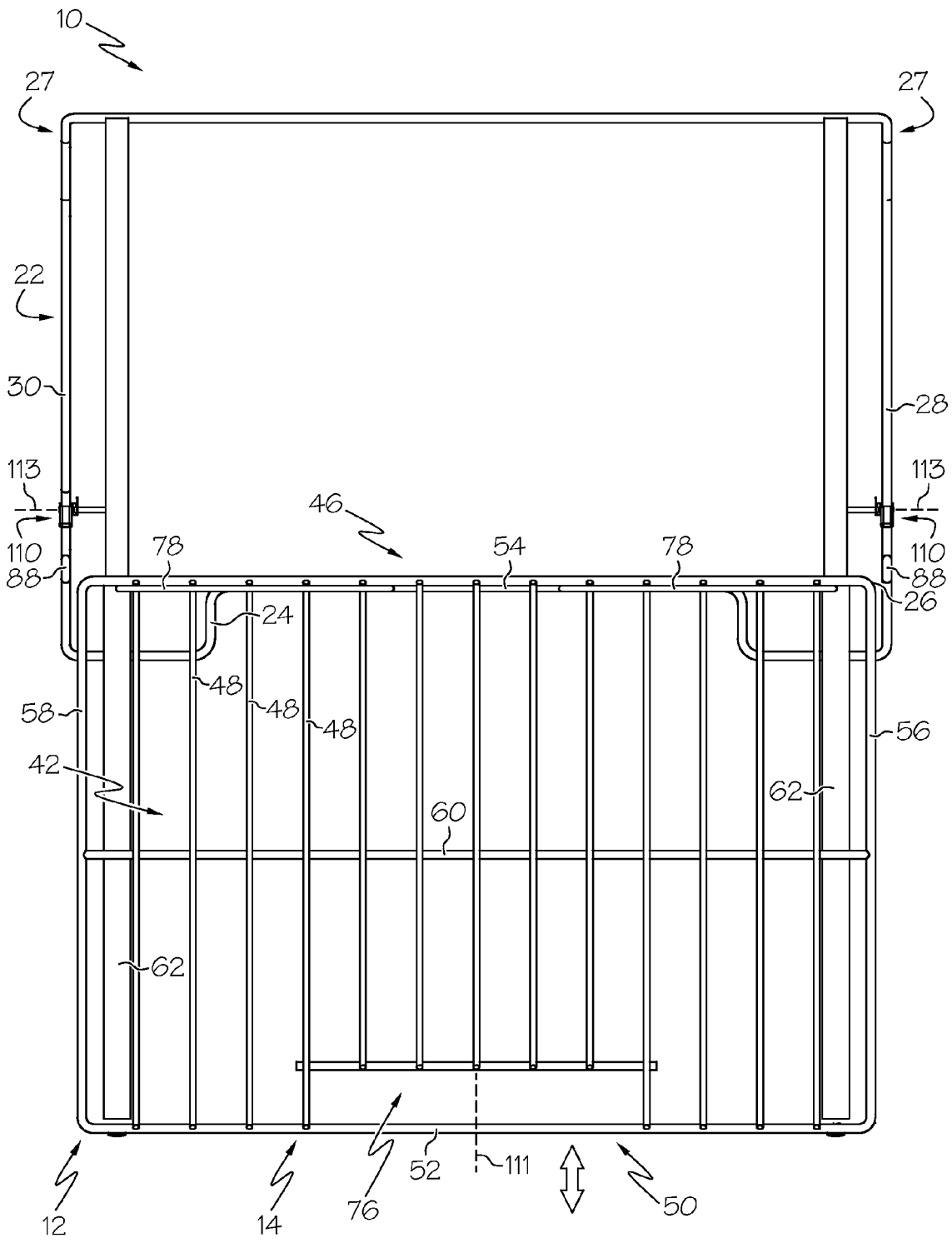
FIG. 2B is similar to FIG. 2A, but illustrates the main section in an example extended position.

As previously mentioned, the rack 10 can also include an auxiliary section 14 having an auxiliary platform area 42. The auxiliary section 14 can be adapted to be slidably coupled by the main section 12 to be moved between a retracted position 44, as shown in FIG. 2A, and an extended position 46, as shown in FIG. 2B. The auxiliary section 14 is adapted to support various items, such as cookware, food, and other items, within the oven. Further, the auxiliary section 14 can be adapted to support various items independent of whether it is in the retracted position 44 or the extended position 46. In another example, when in the extended position 46, or when in the transition between the retracted and extended positions 44, 46, the auxiliary section 14 can also be adapted to independently support various items.

The auxiliary platform area 42 can be formed by a plurality of elongated support bars 48. For example, the auxiliary platform area 42 can include a support frame 50, and the elongated support bars 48 can extend across the support frame 50. As shown, the frame 50 can include a front bar 52, rear bar 54, and apposed side bars 56, 58, and the elongated support bars 48 can extend between the front bar 52 and the rear bar 54, though it is to be appreciated that the support bars 48 can be oriented in various other manners. In addition or alternatively, the auxiliary section 14 can be configured to include various geometries, such as, for example, square, rectangular, triangular, polygonal, circular, oval and/or elliptical, and the rack 10 can even include a plurality of auxiliary sections 14 (not shown).

Additionally, the auxiliary section 14 can include at least one cross member 60 or strengthening member provided across a portion of the auxiliary platform 42 area to provide strength. The cross member(s) 60 operate to mitigate sagging of the auxiliary platform area 42 with respect to the front bar 52 when heavy food, cookware, or the like is placed on the auxiliary platform area 60. Sagging of the auxiliary platform area 42 can present problems with easily sliding the food or cookware therefrom without interference from the front bar 52. The ends of the support members 48 and/or the cross member 60 can be welded (e.g., spot welded), otherwise secured to, or even formed together as a single unit with, the various portions of the auxiliary section 14. Further, the support members 48, frame 50, and/or cross member 60 can be manufactured from metal wire or any other suitable material which provides adequate strength to support items such as cake pans, pizza stones and casseroles, or the like, and withstands the heat of an oven. It is to be appreciated that the cross members 60 can be oriented in various other manners, including transverse or angled relative to the elongated support members 48.

Figure 3:
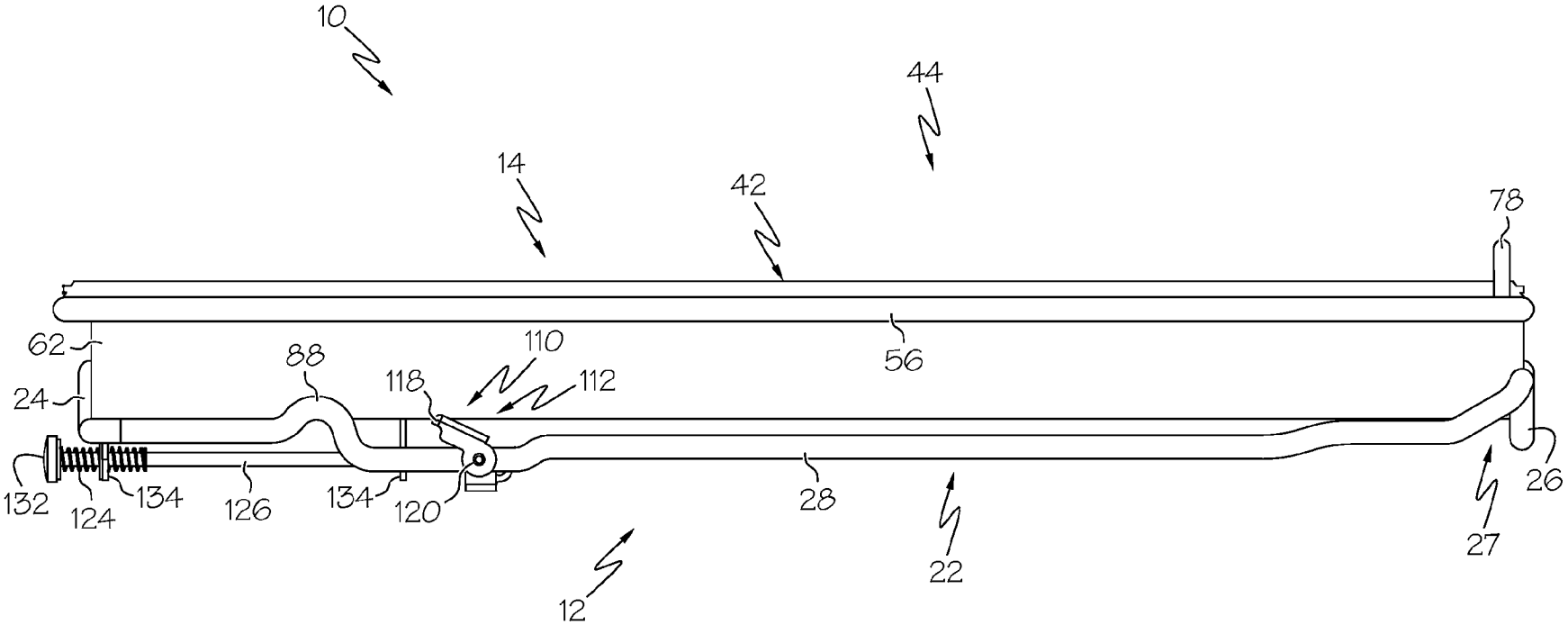
FIG. 3 is similar to FIG. 1, but illustrates a side view.
Figure 4:
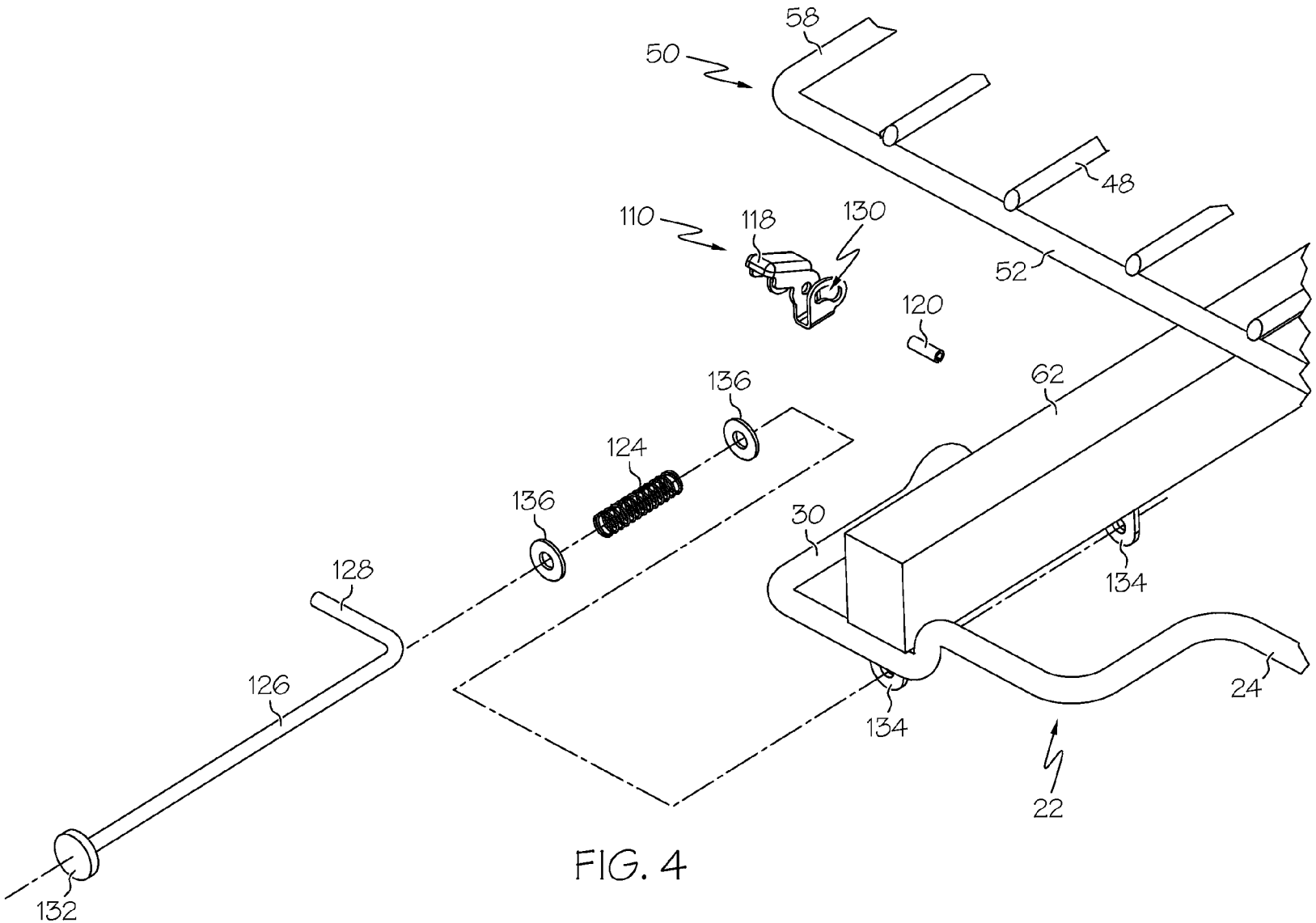
FIG. 4 illustrates an exploded, detail view of FIG. 1 of an example arm and release member in accordance with another aspect of the present invention.

As stated previously, the auxiliary section 14 can be adapted to slidably move relative to the main section 12 between a retracted position 44 and an extended position 46. In addition or alternatively, the auxiliary section 14 can be adapted to telescope relative to the main section 12. Thus, as shown in FIGS. 2 and 3, the auxiliary section 14 can be adapted to move in an overlapping fashion relative to the main section 12 generally along a first axis 111.

The main section 12 and/or the auxiliary section 14 can include various structures to enable the auxiliary section 14 to slidingly and/or telescopically move relative to the main section 12. In one example, the main section 12 can include a pair of telescoping slides 62 (e.g., a pair of telescoping, full extension slides or glides). It is to be appreciated that the slides 62 are shown schematically in FIGS. 1-3. Thus, the slides 62 can include a first portion coupled to the main rack 12, a second portion coupled to the auxiliary rack 14, and sliding structure adapted to permit the first portion to move (e.g., slide, glide, telescope, move in a linear path, etc.) relative to the second portion. For example, where the main section 12 is stationary, the first portion can be stationary, while the second portion can move with the auxiliary section 14. It is to be appreciated that the telescoping slides 62 can also be provided with the auxiliary section 14, and/or both of the main and auxiliary sections 12, 14 can each include a portion of the telescoping slides 62. Further, the telescoping slides 62 can be removably and/or non-removably coupled to either or both of the main and auxiliary sections 12, 14 in various manners, such as by welding, adhesives, fasteners, jointed and/or locking connections, etc.

As is conventional, the main section 12 of the rack 10 can be adapted to move between the retracted and an extended positions relative to an appliance cavity (e.g., an oven cavity 84 or the like, see FIG. 5A), such as for insertion and removal from the appliance cavity. As previously described, the auxiliary section 14 can be further adapted to independently support various items regardless of the positioning of the main section 12. However, when the auxiliary section 14 is in the extended position 46, a large moment arm force is created and applied to the appliance through the main section 12.

Thus, if the main section 12 were in an extended position at the same time that the auxiliary section 14 was in the extended position 46, (i.e., a "double extended" position, such as where the main section 12 is extended from the oven cavity 84, and the auxiliary section 14 is further extended away from the main section 12), a relatively greater moment arm force would be created and applied to the appliance through the main section 12. Such a relatively greater moment arm force could cause the main and/or auxiliary sections 12, 14 to fall out of the appliance cavity, and/or could even cause tipping of the appliance. Thus, it can be beneficial to inhibit the main section 12 from inadvertent movement, such as when the auxiliary section 14 is moved towards the extended position 46.

Correspondingly, the main section 12 can include structure to inhibit inadvertent movement of the main section 12 relative to an appliance cavity. In one example, the main section 12 can include an arm 110 coupled to the support frame 22 and movable relative to the support frame between a first position 112 and a second position 114. The arm 110 can be configured for movement towards engagement with a stop portion 116 of an appliance cavity for inhibiting removal of the main section 12 from the cavity.

As shown in the various figures, the rack 10 is illustrated employed within an oven environment 80. Thus, as shown, the support frame 22 of the main section 12 can be supported by guide rails 82 within an oven cavity 84. The guide rails 82 can be attached to a pair of sidewalls 86 of the oven cavity 84. As shown, the guide rails 82 of the oven 80 can have downward-facing projections 90. In one example, the downward facing projections 90 can act as the stop portion 116 of the cavity 84. The downward facing projections 90 can have a V-shape and can extend a distance from a sidewall 86 towards the interior of the cavity 84, though other geometries are also contemplated. In the shown example, the downward facing projections 90 are attached to (e.g., attached to or even formed with) a portion of each of the guide rails 82.

Thus, in the shown example, the arm 110 is coupled to the support frame 22 and is movable relative to the support frame towards engagement with the downward facing projections 90 (i.e., the stop portions 116). Specifically, when the arm 110 is in the first position 112 (see FIG. 5A), an end 118 of the arm 110 can abut the downward facing projection 90 to inhibit, or even prevent, the main section 12 from being removed from the cavity 84. Conversely, when the arm 110 is in the second position 114 (see FIG. 5B), the end 118 of the arm 110 can move past the downward facing projection 90, with or without contact (e.g., sliding contact), to permit the main section 12 to be removed from the cavity 84. Therefore, movement of the arm 110 between the first and second positions 112, 114 can permit selective removal of the main section 12 from the cavity 84.

Figure 5A:
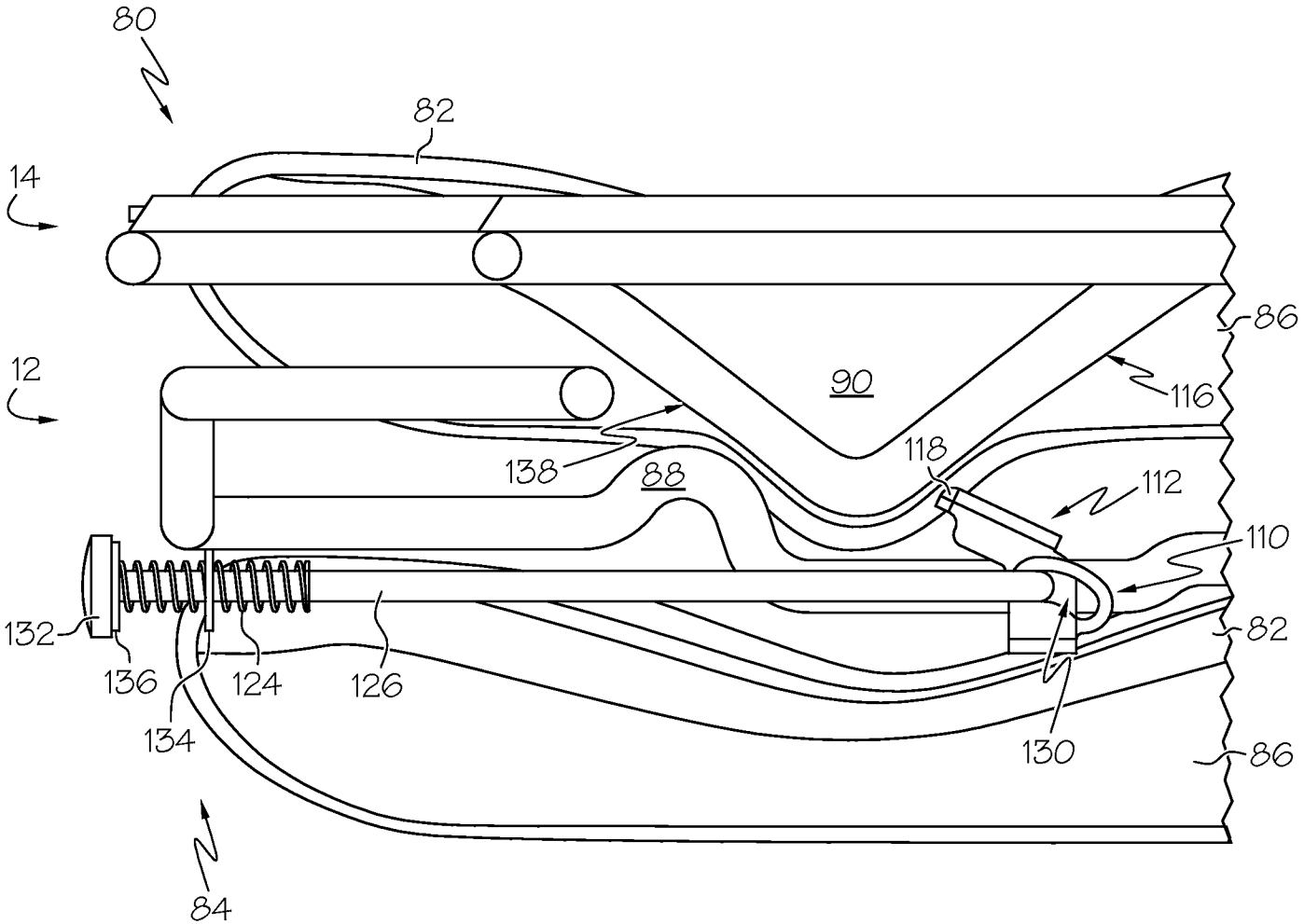
FIG. 5A illustrates a detail view of an example arm and release member with the arm in a first position.
Figure 5B:
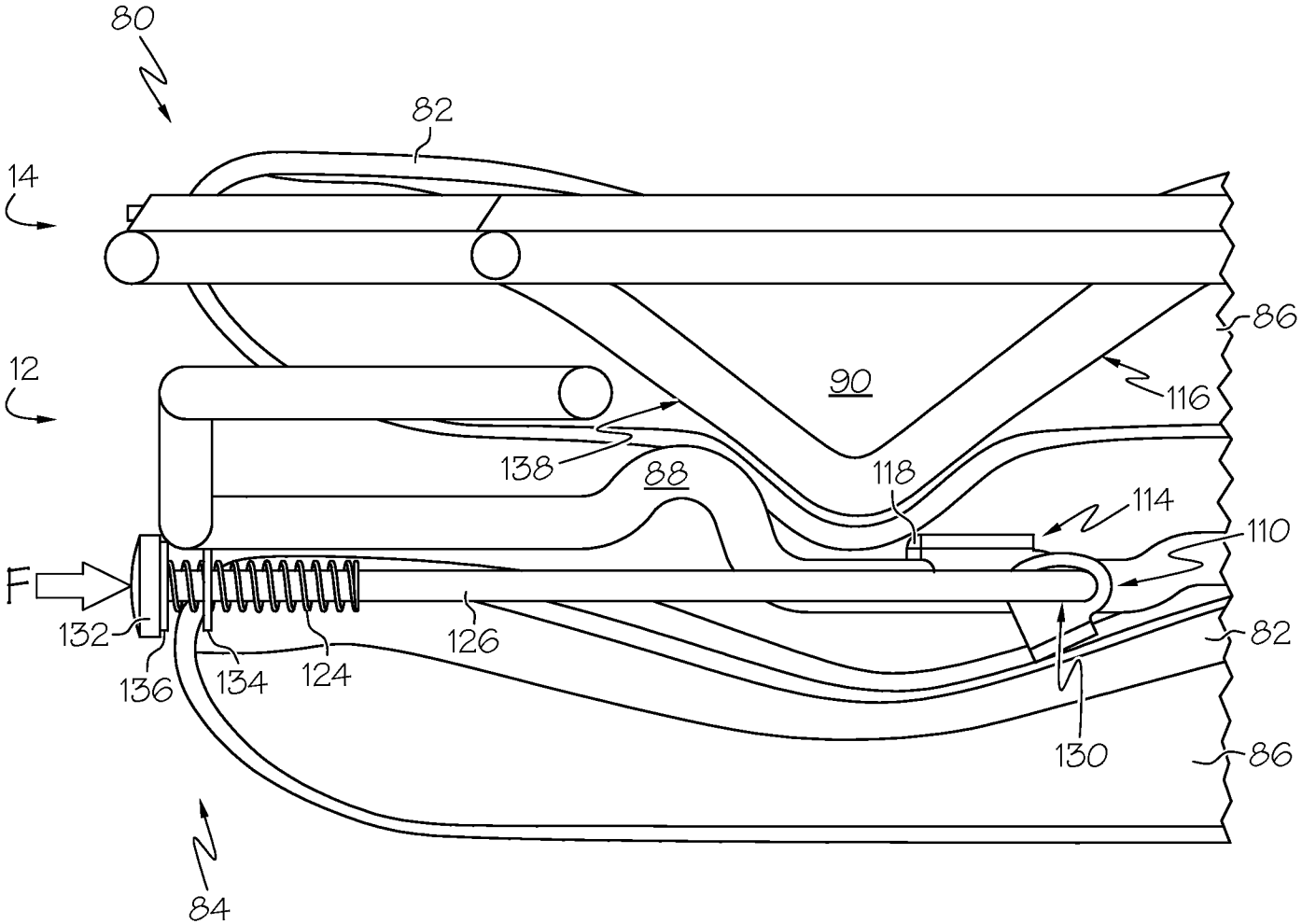
FIG. 5B is similar to FIG. 5A, but shows the arm in a second position.
Figure 5C:
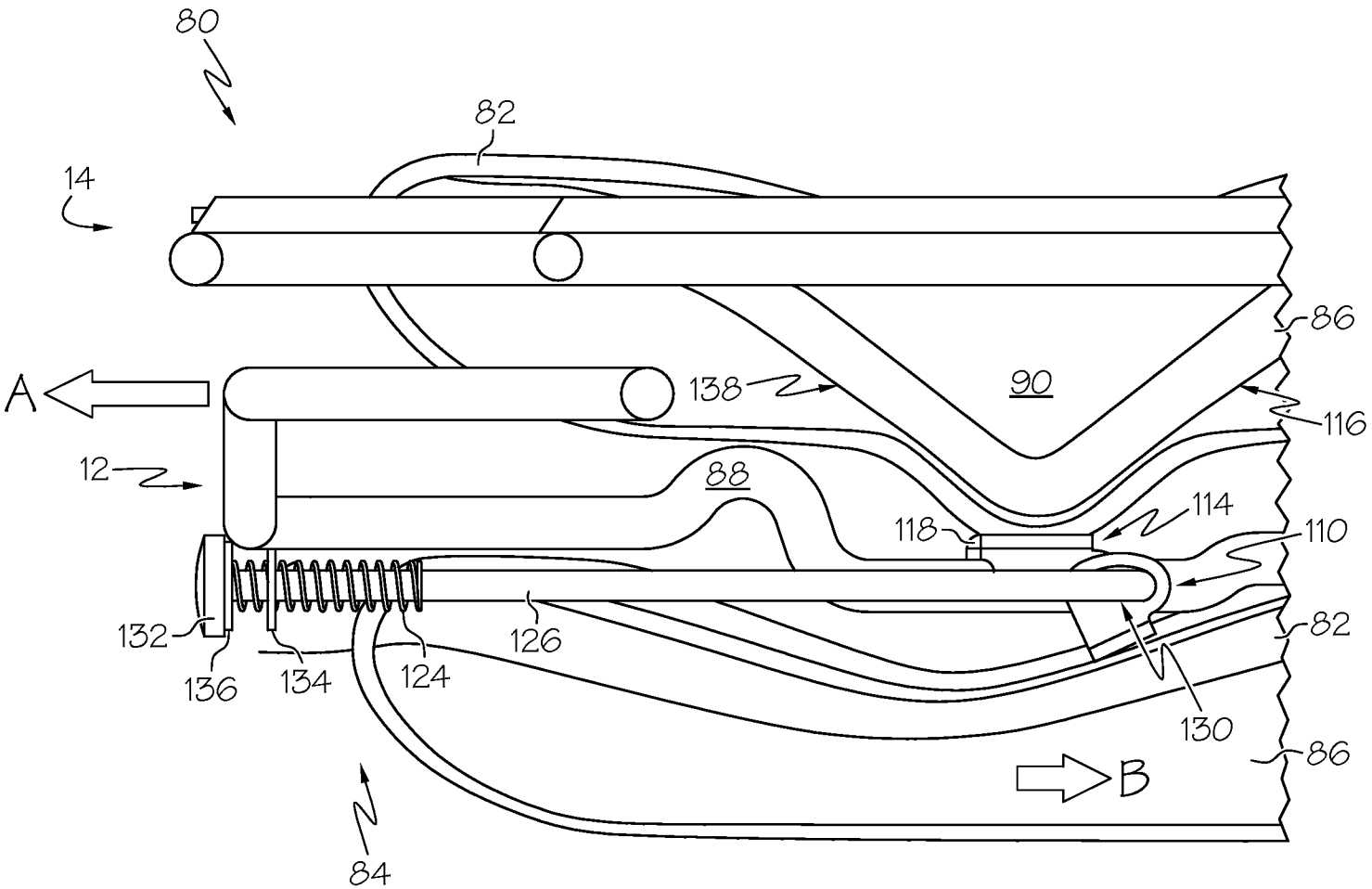
FIG. 5C is similar to FIG. 5B, but shows the glide rack partially removed from an appliance cavity.
Figure 6:
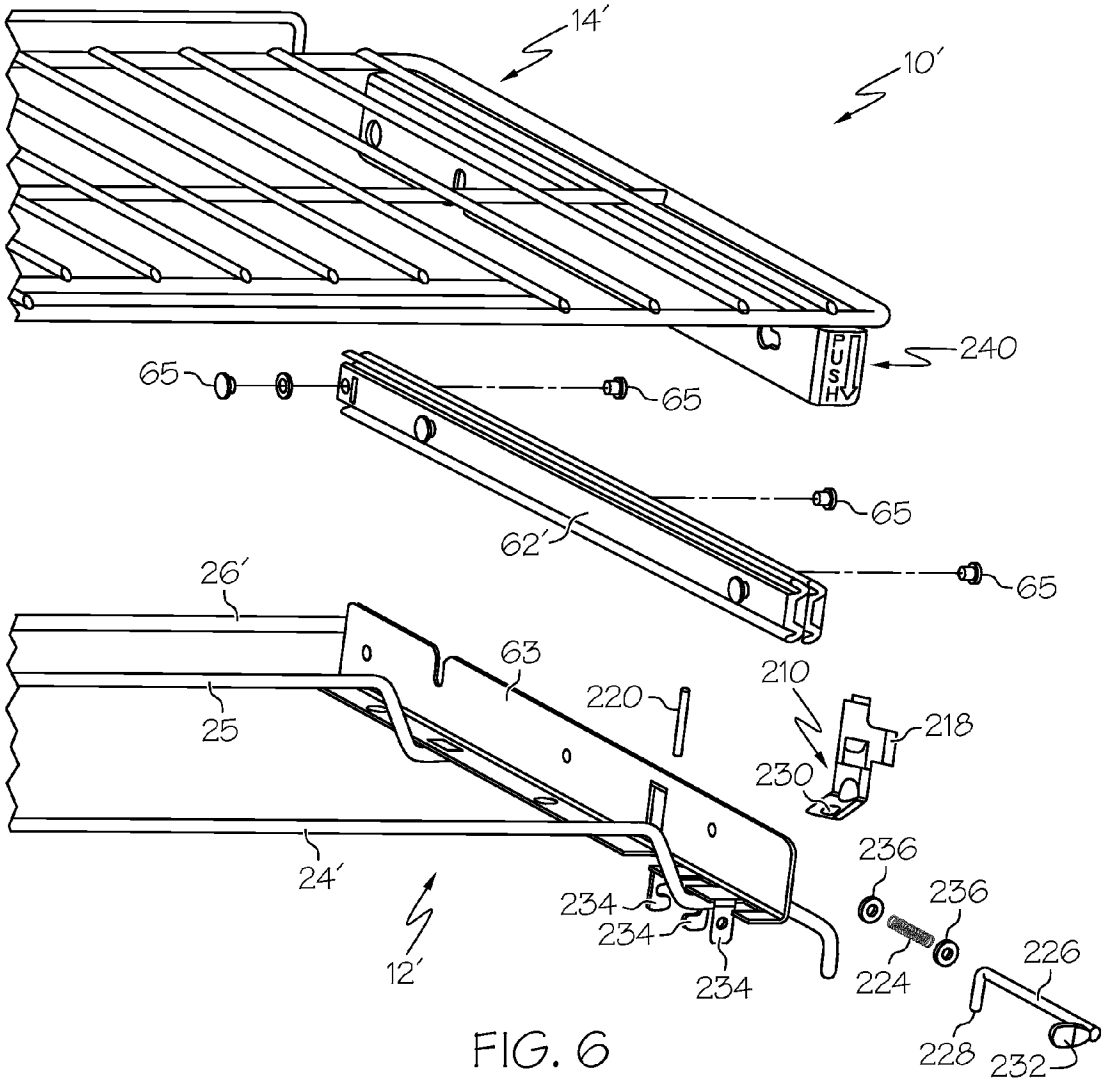
FIG. 6 illustrates an exploded, detail perspective view of another example glide rack having another example arm and release member in accordance with another aspect of the present invention.
Figure 7:
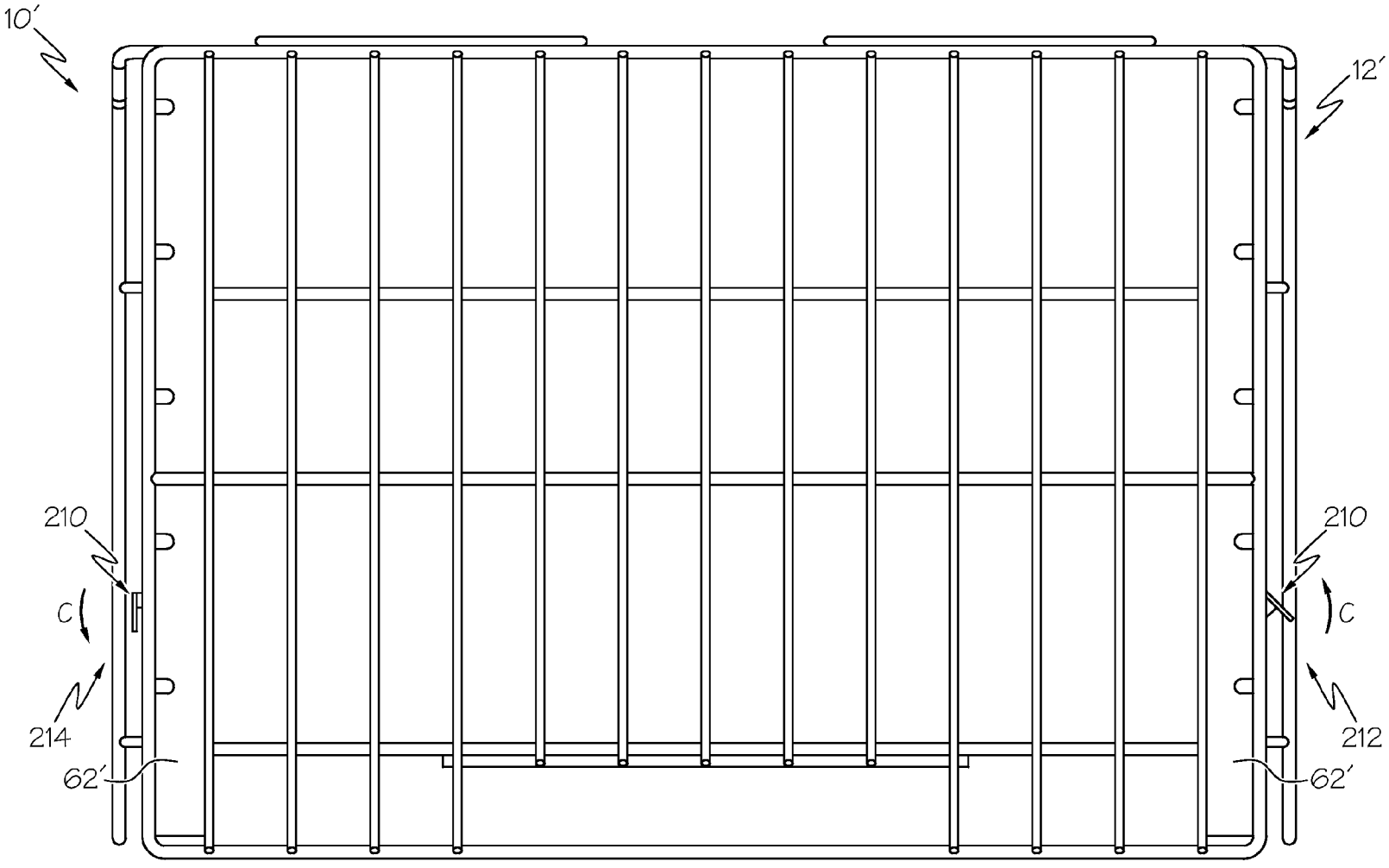
FIG. 7 illustrates a top view of the glide rack of FIG. 6.
Figure 8:
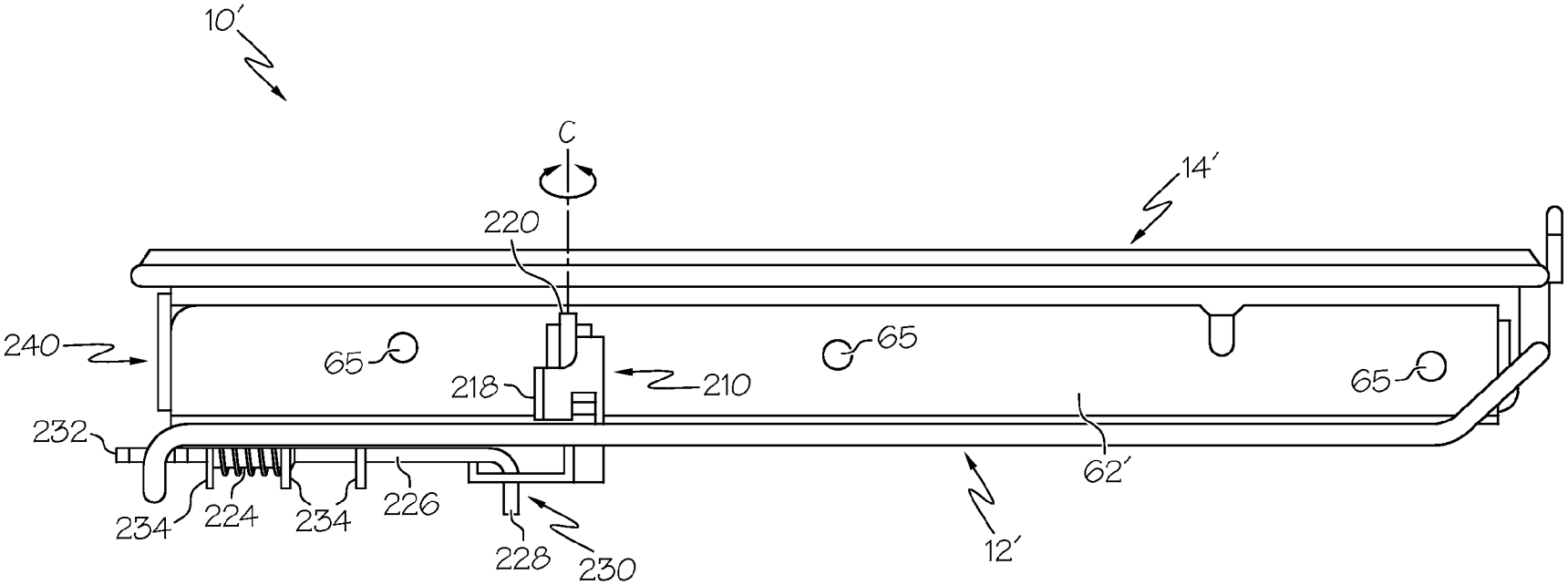
FIG. 8 illustrates a side view of the glide rack of FIG. 6.

As can be appreciated, various structure and/or methodologies can be used to control the selective movement of the arm 110 between the first and second positions 112, 114. In one example, as shown in FIGS. 1-5C, the arm 110 can be pivotally coupled to the main section 12 for pivotal or rotational movement relative to the main section 12. The pivotal or rotational movement can be vertically up and down relative to the main section 12, such as shown in FIGS. 1-5C and/or 9-10B, or can be horizontally in and out relative to the main section 12, such as shown in FIGS. 6-8. In addition or alternatively, though not shown, the arm can also be configured for linear motion so as to move horizontally in and out, vertically up and down, and/or even in an angled or curved motion, relative to the main section 12. It is to be appreciated that various other pivotal or rotational movements are also contemplated.

The arm 110 can be pivotally or rotationally coupled to the main section 12 in various manners. For example, as shown, the arm 110 can be pivotally coupled to the main section 12 by way of a pin 120 or the like that can rotate relative to the main section 12 within a hole 122 extending partially or completely through the support frame 22. The arm 110 can include two leg portions that are adapted to straddle a side bar 28, 30 of the support frame 22 while being coupled thereto by the pin 120. Alternatively, the arm 110 can be directly coupled to the support frame 22, such as by being welded to or even formed therewith. In such a case, movement of the arm 110 relative to the main section 12 would be by way of deflection of the arm 110 from a nominal position (such as the first position 110) towards a rotated or pivoted position (such as the second position 112). Additionally, the arm 110 can pivot about a second axis 113 that is generally orthogonal to the first axis 111 (e.g., the movement axis of the auxiliary rack 14), though the arm 110 can also pivot about various other axes.

Additionally, the movement of the arm 110 can be caused by various automatic and/or manual mechanisms. In one example, as shown in FIGS. 5A-5C, the arm 110 can be resiliently biased towards the first position 110 for engagement with the downward facing projection. The arm 110 can be resiliently biased in various manners, such as by a spring 124 or the like that is directly or indirectly coupled thereto. The spring 124 could be directly coupled to the arm 110, such as between the arm 110 and the support frame 22 about the area of the pin 120, or alternatively could be indirectly coupled to the arm, such as by way of a release mechanism, as will be discussed more fully herein. In addition or alternatively, where the arm 110 is directly coupled to the support frame 22, deflection of the arm 110 (such as from the nominal first position 112 towards the deflected second position 114) could be resisted by a resilient spring force of the arm 110. Despite the mechanism, it can be beneficial to bias the arm 110 towards the first position 112 so as to place the arm 110 in a position to inhibit inadvertent removal of the main section 12 from the cavity 84.

In addition or alternatively, as previously mentioned, the rack 10 can also include a release mechanism for manually moving the arm 110 from the first position 112 to the second position 114 to thereby disengage the arm 110 from the projection 90. It is to be appreciated that the term "disengage" is not meant to imply that the arm 110 must be physically in contact with the projection 90, though it may be, but rather that the arm 110 is moved to such a position so as to be permitted to move past the projection 90 when desired. Thus, the rack 10 can include a release member 126 operatively connected to the arm 110, whereby actuation of the release member 126 can cause the arm 110 to disengage from the stop portion 116 (e.g., the downward facing projection 90). Subsequently, the main section 12 of the rack 10 can be removed from the appliance cavity 84 (i.e., movement of the rack in the direction of arrow A).

The rack 10 can include various release members 126 having various geometries and operational manners. In one example, the release member 126 can include a link member 128 attached thereto or formed therewith. The link member 128 can include a projection extending from a portion of the release member 126 for engagement with the arm 110. As shown, the arm 110 can include a cam groove 130 adapted to interact with the link member 128. In one example, the link member 128 can be received by the cam groove 130, and movement of the link member 128 within the cam groove 130 can cause the arm 110 to move between the first and second positions 112, 114. Thus, the cam groove 130 can have a geometry such that movement of the link member 128 within the cam groove 130 can cause the arm 110 to disengage from the stop portion 116. It is to be appreciated that the cam groove 130 can have various geometries, and that such geometry can be adapted to move the arm 110 in a motion and/or direction so as to engage or disengage the arm 110 from the projection 90, as desired.

The release member 126 can also include other structure to facilitate actuation thereof. The release member 126 can include an input member 132 for receiving input from a user. For example, the input member 132 can include a push member for being pushed by the hand of a user, such as by a finger or palm. Thus, when a user desires to actuate the release member 126, the user can press upon the input member 132 with a force F to push the release member 126 towards the arm 110, whereupon the link member 128 can move within the cam groove 130 to thereby disengage the arm 110 from the projection 90. Alternatively, the input member 132 can be configured to be moved in various other manners, such as by being pulled, rotated, pivoted, moved linearly or angularly, or various combinations thereof. Further still, the release member 126 can be movably coupled to the main section 12 in various manners, such as by one or more hanging support brackets 134 or the like. The release member 126 can also include one or more elements for transferring a force between the release member 126 and the spring 124, such as washers 136 or the like, though other elements can also be used. For example, the spring 124 can be caught between one or more of the input member 132, washers 136, and/or the hanging support brackets 134.

It is to be appreciated that the engagement between the link member 128 and the cam groove 130 can be configured so as to permit the arm 110 to move in response to outside forces other than those supplied by the release member 126. For example, the appliance can include a cam portion 138 that precedes the stop portion 116 for causing an initial movement of the arm 110 during insertion of the rack 10 into the appliance cavity. In one example, as shown in FIG. 5C, the cam portion 138 can be the portion of the V-shaped downward facing projection 90 opposite the stop portion 116. Thus, during insertion of the rack 10 into the appliance cavity (i.e., movement of the rack in the direction of arrow B), the cam portion 138 can be configured to automatically move the arm 110 from the first position 112 and towards the second position 114 to permit the arm 110 to pass beyond the V-shaped downward facing projection 90. After the arm 110 passes beyond the cam portion 138, the arm 110 can be moved back to the first position 112 to thereby inhibit the main section 12 from being removed from the appliance cavity. For example, where the arm 110 is resiliently biased towards the first position 112, the arm 110 can automatically return to the first position 112 after it has moved beyond the cam portion 138. Thus, the main portion 12 can be easily and quickly inserted into the appliance cavity without the user having to manually move the arm 110 beyond the downward facing projection 90, and likewise the main portion 12 can automatically "lock" itself into position to inhibit inadvertent removal without requiring additional user input.

In another example embodiment, as shown in FIGS. 6-8, the rack 10' can include an arm 210 that can be configured to pivot horizontally in and out (e.g., about arrow C) relative to the main section 12'. It is to be appreciated that for the sake of consistency, elements similar to those discussed previously herein are labeled with a prime designation ('), though such elements can also be different. For example, the main section 12' can include a front bar 24' and a rear bar 26', and can also include an intermediate bar 25 to provide additional structural stability. The intermediate bar 25 can be oriented similar to the front and rear bars 24', 26', and/or can even be oriented transversely to extend between the front and rear bars 24', 26'. Similarly, the telescopic slide/glide assembly 62' can be coupled to the main section 12' by way of a mounting plate 63 through the use of fasteners 65, welding, adhesives, locking and/or interference connections, or the like.

As before, the arm 210 can move (e.g., pivot or rotate) between a first position 212 (see right-hand side of FIG. 7) and a second position 214 (see left-hand side of FIG. 7). In the first position 212, an end 218 of the arm 210 can engage a stop portion of the appliance cavity, such as the downward-facing projection 90. Conversely, when in the second position 214, the end 218 of the arm 210 can be permitted to move past the projection 90 (e.g., similar to stop portion 116), with or without contact. Also similar to before, the downward-facing projection 90 can be generally V-shaped such that the end 218 of the arm 210 can engage a cam portion (not shown, but similar to cam portion 138) to automatically move the arm 210 from the first position 212 and towards the second position 214 to permit the arm 210 to pass beyond the V-shaped downward facing projection 90 during insertion of the main section 12' into the appliance cavity.

Also as before, the arm 210 can be pivotally coupled to the main section 12' by way of a pin 220 or the like. The arm 210 can be resiliently biased towards the first position 212, such as by way of a spring 224 or the like. Additionally, a release member 226 can be configured to cause the arm 210 to disengage from the stop portion (e.g., the downward facing projection 90) to permit the main section 12' of the rack 10' to be removed from the appliance cavity. As before, the release member 226 can include a link member 228 attached thereto or formed therewith that can include a projection or the like for engagement with the arm 210. As shown, the arm 210 can include an aperture, or even a cam groove 230, adapted to interact with the link member 228 such that movement of the link member 228 within the aperture or cam groove 230 can cause the arm 210 to move between the first and second positions 212, 214. It is to be appreciated that the aperture and/or cam groove 230 can have various geometries, and that such geometry can be adapted to move the arm 210 in a motion and/or direction so as to engage or disengage the arm 210 from the projection 90, as desired.

Also as before, the release member 226 can also include other structure to facilitate actuation thereof, such as an input member 232 for receiving input from a user. The input member 232 can be configured to be moved in various manners, such as by being pushed, pulled, rotated, pivoted, moved linearly or angularly, or various combinations thereof. The release member 226 can be movably coupled to the main section 12' in various manners, such as by one or more hanging support brackets 234 or the like. Additionally, the release member 226 can also include one or more elements for transferring a force between the release member 226 and the spring 224, such as washers 236 or the like, though other elements can also be used. It is to be appreciated that the above described example embodiment can operate in a similar manner to that of the other rack 10 described previously herein, though can also include more or less elements. For example, the rack 10' can include instructions 240 for operation of the arm 210 and/or release member 226, such as alpha-numeric characters, symbols, indicia, etc.

Figure 9:
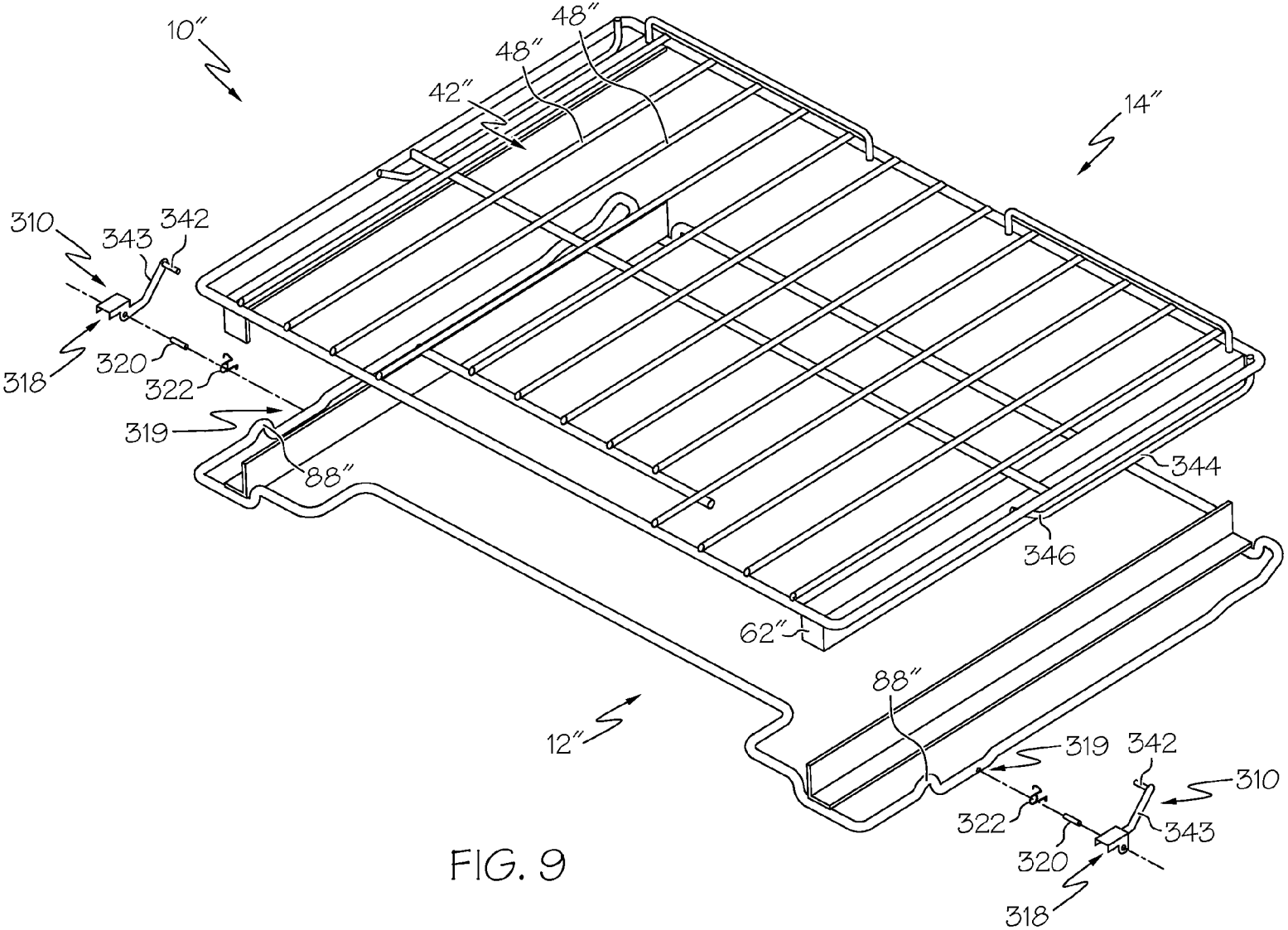
FIG. 9 illustrates an exploded, detail perspective view of another example glide rack having another example arm and release member in accordance with another aspect of the present invention.
Figure 10A:
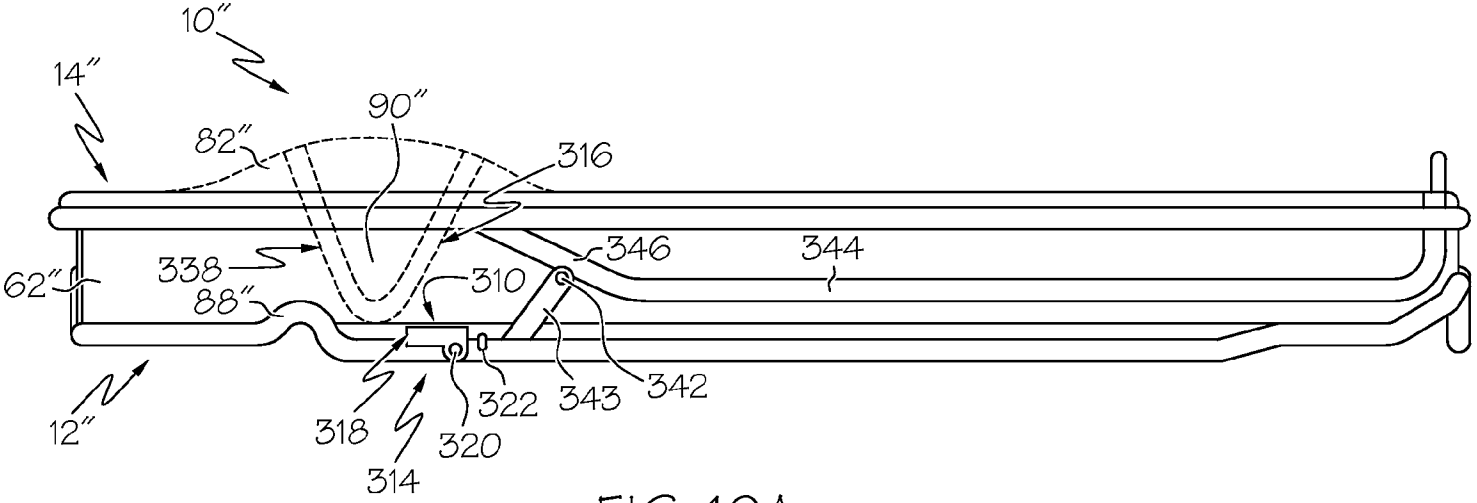
FIG. 10A illustrates an example arm and release member of the glide rack of FIG. 9 with the arm in a second position.
Figure 10B:
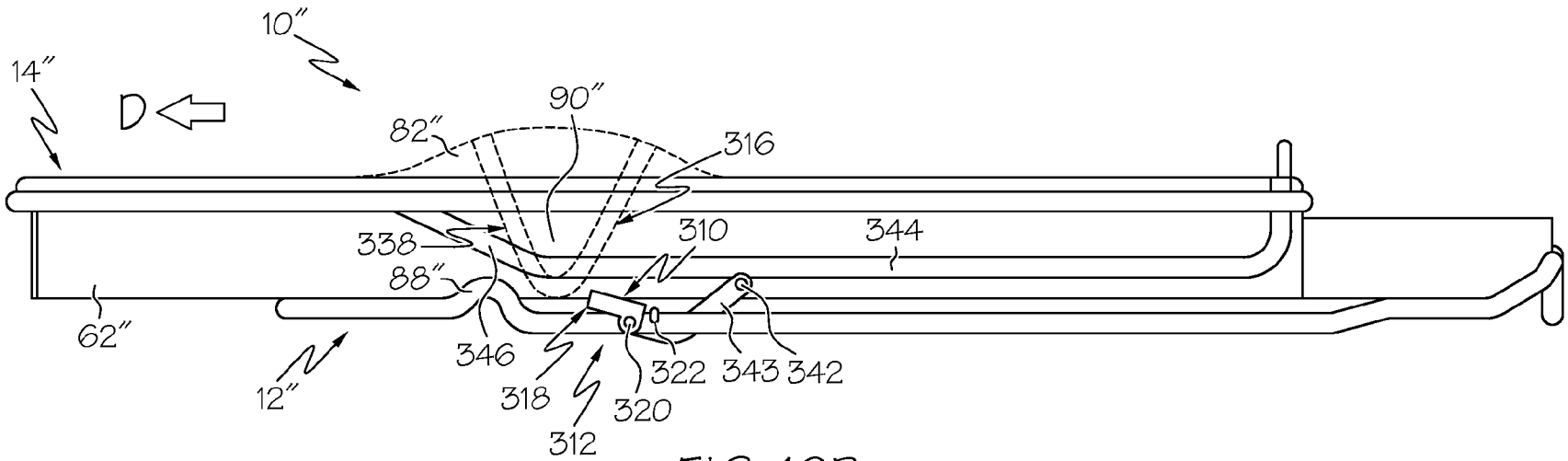
FIG. 10B illustrates an example arm and release member of the glide rack of FIG. 9 with the arm in a first position.

In yet another example embodiment, as shown in FIGS. 9-10B, the rack 10" can include an arm 310 that can be configured to pivot vertically up and down, relative to the main section 12", automatically in response to movement of the auxiliary section 14". It is to be appreciated that for the sake of consistency, elements similar to those discussed previously herein are labeled with a double prime designation ("), though such elements can also be different. Though the arm 310 can be resiliently biased towards either of a first and/or second position 312, 314, it is to be appreciated that the motion of the auxiliary section 14" itself can automatically cause the movement of the arm 310.

As shown in FIG. 10A, the arm 310 is shown in the second position 314. In such a position, the main section 12" of the rack 10" can be easily removed or inserted into the appliance cavity 84" by way of the guide rails 82". As before, the rack 10" can include an auxiliary section 14" moveable relative to the main section 12" by way of telescoping slides/glides 62".

The arm 310 can also be pivotally or rotationally coupled to the main section 12" in various manners, though it can also be configured for movement along a linear path. For example, as shown, the arm 310 can be pivotally coupled to the main section 12" by way of a pin 320 or the like that can rotate relative to the main section 12" within a hole 319 extending partially or completely therethrough. The arm 310 can also include a release member 342 coupled thereto for moving the arm between the first and second positions 312, 314. As shown, the release member 342 can include a projection extending a distance outward from the arm 310. The release member 342 can be spaced a distance from the arm 310 by way of an extension 343 or the like adapted to facilitate movement of the arm 310 between the first and second positions 312, 314. Additionally, the auxiliary section 14" can include actuation elements adapted to engage the release member 342 for automatically moving the arm 310 in response to movement of the auxiliary section 14".

In one example, the actuation elements can include a control member 344 having a transition portion 346 for facilitating movement of the release member 342. The control member 344 can be coupled to the auxiliary section 14" to as to move correspondingly therewith. For example, the control member 344 can include a bar, similar to the elongated support members 48" that form the auxiliary platform area 42", though the control member 344 can also include various other materials and/or geometries. As shown, the control member 344 can be suspended below the auxiliary platform area 42", and the transition portion 346 can include a ramped portion extending generally between the auxiliary platform area 42" and the control member 344.

In one example operation, as shown in FIG. 10A, the auxiliary section 14" is in a retracted position relative to the main section 12". The control member 344 and transition portion 346 are spaced a distance from the release member 342. Next, as shown in FIG. 10B, when the auxiliary section 14" is moved towards the extended position along the direction indicated by arrow D, the control member 344 and transition portion 346 corresponding move towards the release member 342. The transition portion 346 first contacts the release member 342, and the ramped geometry of the transition portion 346 acts as a cam to drive the release member 342 downwards. The release member 342 is driven downwards until it contacts the control member 344, which maintains the release member 342 in a downward position while the auxiliary section 14" is in the extended position. While the release member 342 is being driven or held downwards, the arm 310 can pivot and/or rotate about the pin 320 towards the first position 312 such that an end 318 of the arm 310 engages the stop portion 316 (i.e., the downward-facing projection 90 of the guide rail 82). The engagement of the end 318 of the arm 310 and the stop portion 316 inhibits, or even prevents, the main section 12" from being inadvertently removed from the appliance cavity while the auxiliary section 14" is in the extended position. As can be appreciated, the interaction of the control member 344 and the release member 342 will maintain the engagement of the arm 310 with the stop portion 316.

Next, when the auxiliary section 14" is moved back to the retracted position (i.e., the reverse direction of arrow D), the control member 344 and the transition portion 346 will disengage from the release member 342. The arm 310 will pivot back towards its initial position (i.e., the second position 314) under the force of gravity, whereupon the main section 12" can be removed from the appliance cavity, if desired.

The arm 310 can also include various other features. In one example, the arm 310 can be resiliently biased towards either, or both, of the first and/or second positions 312, 314. For example, a spring 322 or the like could be used, such as a torsion spring. In addition, an over-center spring or the like could be used to resiliently bias the arm 310 towards either of the first or second positions 312, 314 depending upon the orientation of the arm 310 relative to the over-center spring.

In another example feature, the arm 310 can be configured to engage a cam portion 338 that precedes the stop portion 318 (e.g., such as the portion of the V-shaped downward facing projection 90" opposite the stop portion 316) for causing an initial movement of the arm 310 during insertion of the rack 10" into the appliance cavity. Thus, during insertion of the rack 10" into the appliance cavity, the cam portion 338 can be configured to automatically engage the end 318 of the arm 310 to move the arm 310 from the first position 312 and towards the second position 314 to permit the arm 310 to pass beyond the V-shaped downward facing projection 90". After the arm 310 passes beyond the cam portion 338, gravity and/or a resilient spring force can move the arm 310 back to the second position 314 (see FIG. 10A) as described above. Thus, the main portion 12" can be easily and quickly inserted into the appliance cavity without the user having to manually move the arm 310.

The rack 10 can also include various other features. In one example, various elements can include coatings or other treatments to inhibit or prevent damage to other elements. For example, either or both of the end 118 of the arm 110 and/or the downward-facing projection 90 can include a coating or treatment to inhibit damage thereto. Various coatings or treatments can be used, such as ceramic and/or polymer coatings, hardening treatments, surface treatments, etc.

In another example, in place of an outward extending projection, the stop portion 116 could be replaced by an aperture (not shown) or the like. The aperture could include a detent, or even a hole, extending partially or completely through the sidewall 85 of the appliance cavity. For example, instead of abutting a projection 90 to inhibit removal of the main section 12, the end 118, 218 of the arm 110, 210 could be received within the aperture. Thus, interaction of the end 118, 218 with the aperture could inhibit the main section 12 from being removed, and subsequent extraction of the end 118, 218 from the aperture could permit the main section 12 to be removed from the cavity.

In another example, the auxiliary platform 14 can include a handle portion 76 adapted to facilitate movement of the auxiliary platform from the retracted position 44 to the extended position 46. As shown, the handle 76 can be formed of a similar material as the main rack 12 (e.g., metal wire or the like) and can be attached to (e.g., welding or the like), or formed with, the front bar 52 of the auxiliary section 14. In addition or alternatively, the handle 76 can also be disposed at various other locations, and can even be formed as part of the front bar 52. The handle 76 can be configured to be grasped to a hand of a user, and can include various coatings and/or a covering member (e.g., silicone, porcelain, ceramic, or the like) adapted to insulate a user's hand from the heat of an oven. In addition or alternatively, the main section 12 can also include a handle (not shown) to facilitate movement of the rack 10 relative to the oven cavity 84. It is to be appreciated that the various additional features discussed herein are not intended to provide any limitation upon the present invention, and that modification of the features and or the addition of other features are contemplated to be within the scope of the invention.

Further still, the auxiliary section 14 can include a rear stop 78 for limiting the placement of items upon the auxiliary platform area 42. For example, as shown, a pair of rear stops 78 can be removably or non-removably attached for the rear bar 54, such as by welding, adhesives, fasteners, etc. The rear stop(s) 78 can limit the extent to which items can be placed within the appliance cavity, and can also facilitate removal of items from the appliance cavity. For example, when the auxiliary section 14 is moved to the extended position 46, the rear stops 78 can inhibit relative movement (e.g., such as might be caused by inertia) between an item supported on the auxiliary section 14, and the auxiliary section 14 itself. As the auxiliary section 14 is drawn out of the appliance cavity, the rear stop(s) 78 can abut a supported item to inhibit slipping draw the item out along with the auxiliary section 14.

Even further still, the auxiliary section 14 can be adapted to be removable from the main section 12. For example, the auxiliary section 14 can be completely removed from the main section 12 such that the main section can remain within an oven while the auxiliary section 14 is removed therefrom. For example, when the auxiliary section 14 is removed from the main section 12, it can be stored or used as a cooling rack for supporting hot items or baked goods on a counter top. In one example, the auxiliary section 14 can be removed from the main section 12 by orienting it at an angle relative to the main section 12 to release the glides/slides 62 to thereby disengage the auxiliary section 14 from the main section 12, though other methods of removal are also contemplated. It is to be appreciated that the glides/slides 62 may be removable with the auxiliary section 14, or may remain coupled to the main section 12.

Accordingly, with the rack 10 supported within the oven cavity 84, the auxiliary platform area 42 of the auxiliary section 14 can be utilized to support various items for cooking within the oven. As shown in FIGS. 2A-2B, the auxiliary section 14 can be supported with in the oven cavity 84 in either of the retracted and/or the extended positions 44, 46. Thus, for example, various items could be easily retrieved from the auxiliary section 14 without also having to extend the main section 12. It is to be appreciated that the arm 110, 210, 310 is configured, as described variously above, to inhibit or even prevent the main section 12 from also extending from the cavity while the auxiliary section 14 is in the fully extended position 46. In addition or alternatively, various items can also be supported on other oven racks (not shown) simultaneously without the need to add or remove any other racks.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for an appliance, including: a main section having a support frame; an arm coupled to the support frame and positioned at a front half of the rack, the arm pivotable relative to the support frame between a first position and a second position, the arm being configured to pivot towards the first position and to engage a stop portion of an appliance cavity for inhibiting removal of the main section therefrom, wherein the stop portion is positioned at a front half of the appliance cavity;

a release member coupled to the support frame and operatively connected to the arm, actuation of the release member causing the arm to move from the first position to the second position, the release member comprising an input member for moving the release member relative to the arm for actuation; and an auxiliary section having an auxiliary platform area and adapted to be slidably coupled to the main section so as to move relative to each of the support frame, the arm and the release member, between a retracted position and an extended position.

2. The rack of claim 1, wherein the arm is adapted to engage a projection attached to a portion of a guide rail of an appliance when the arm is in the first position.

3. The rack of claim 1, wherein the arm is resiliently biased towards the first position.

4. The rack of claim 1, wherein the release member includes a link member and the arm includes a cam groove, movement of the link member within the cam groove causing the arm to move from the first position to the second position.

5. The rack of claim 1, wherein the auxiliary section is slidably coupled to the main section by a pair of telescoping slides.

6. The rack of claim 1, further including a control member operatively connected to the auxiliary section, the control member being movable with the auxiliary section for actuating the release member, actuation of the release member causing the arm to move towards the first position.

7. An appliance, including:

an appliance cavity having a pair of sidewalls, each sidewall having a guide rail formed therein, the guide rail including at least one stop portion positioned at a front half of the appliance cavity; and a rack for supporting items within the appliance cavity, including:

a main section having a support frame adapted to be supported by the guide rails;

an arm coupled to the support frame and movable relative to the support frame, the arm being movable towards engagement with the stop portion for inhibiting removal of the main section from the appliance cavity;

a release member coupled to the support frame and operatively connected to the arm, actuation of the release member causing the arm to disengage from the stop portion, the release member comprising an input member for moving the release member relative to the arm for actuation; and an auxiliary section having an auxiliary platform area and adapted to be slidably coupled to the main section so as to move relative to each of the support frame, the arm and the release member, between a retracted position and an extended position.

8. The appliance of claim 7, wherein the stop portion includes a projection attached to a sidewall.

9. The appliance of claim 8, wherein the projection is attached to a portion of a guide rail.

10. The appliance of claim 8, wherein the arm is pivotally coupled to the support frame for movement between a first position and a second position, the arm being resiliently biased towards the first position for engagement with the projection.

11. The appliance of claim 7, wherein the release member includes a link member and the arm includes a cam groove, movement of the link member within the cam groove causing the arm to disengage from the stop portion.

12. The appliance of claim 7, wherein the arm is movable between a first position and a second position, the appliance further including a cam portion preceding the stop portion such that, during insertion of the rack into the appliance cavity, the cam portion is configured to automatically move the arm away from the first position and towards the second position, whereupon passage of the arm beyond the cam portion permits the arm to be resiliently biased back towards the first position.

13. The appliance of claim 7, wherein the auxiliary section is slidably coupled to the main section by a pair of telescoping slides.

14. The appliance of claim 7, further including a control member operatively connected to the auxiliary section, the control member being movable with the auxiliary section for actuating the release member, actuation of the release member causing the arm to engage the stop portion.

15. An appliance, including;

an appliance cavity having a pair of sidewalls, each sidewall having a guide rail formed therein, the guide rail including at least one stop portion positioned at a front half of the appliance cavity; and a rack for supporting items within the appliance cavity, including:

a main section having a support frame adapted to be supported by the guide rails;

an auxiliary section having an auxiliary platform area, the auxiliary section being adapted to be slidably coupled to the main section for movement along a first axis between a retracted position and an extended position;

an arm coupled to the support frame and pivotable relative to the support frame about a second axis generally orthogonal to the first axis, the arm being movable away from the main section and towards engagement with the stop portion for inhibiting removal of the main section from the appliance cavity, and a release member coupled to the support frame and operatively connected to the arm, actuation of the release member causing the arm to pivot about the second axis towards the main section to thereby disengage the arm from the stop portion, the release member comprising an input member for moving the release member relative to the arm for actuation; wherein the auxiliary section is movable along the first axis relative to each of the support frame, the arm and the release member, between the retracted position and the extended position.

16. The appliance of claim 15, wherein the release member includes a link member and the arm includes a cam groove, movement of the link member within the cam groove causing the arm to pivot about the second axis.

17. The appliance of claim 15, further including a control member operatively connected to the auxiliary section, the control member being movable with the auxiliary section for actuating the release member, actuation of the release member causing the arm to engage the stop portion.

18. The appliance of claim 15, wherein the arm is resiliently biased away from the main section and towards engagement with the stop portion.

19. The appliance of claim 15, wherein the stop portion includes a projection attached to a sidewall.

* * * * *